US007430882B2

(12) United States Patent
Nakayama

(10) Patent No.: US 7,430,882 B2
(45) Date of Patent: Oct. 7, 2008

(54) METHOD OF KNITTING TUBULAR KNITTED FABRIC HAVING STRIPE PATTERN, AND TUBULAR KNITTED FABRIC HAVING STRIPE PATTERN

(75) Inventor: Tomoaki Nakayama, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 465 days.

(21) Appl. No.: 10/567,115

(22) PCT Filed: Aug. 4, 2004

(86) PCT No.: PCT/JP2004/011142

§ 371 (c)(1),
(2), (4) Date: Feb. 3, 2006

(87) PCT Pub. No.: WO2005/014902

PCT Pub. Date: Feb. 17, 2005

(65) Prior Publication Data

US 2008/0169041 A1 Jul. 17, 2008

(30) Foreign Application Priority Data

Aug. 8, 2003 (JP) ..... 2003-290334

(51) Int. Cl.
*D04B 7/04* (2006.01)

(52) U.S. Cl. ..... 66/64; 66/170; 66/201

(58) Field of Classification Search ..... 66/64, 66/69, 169 R, 180, 170, 196, 75.1
See application file for complete search history.

(56) References Cited

U.S. PATENT DOCUMENTS 3,990,271 A * 11/1976 Jeffcoat ..... 66/176
5,628,209 A * 5/1997 Ikegami ..... 66/60 R
6,578,389 B1 6/2003 Okamoto et al.
6,715,324 B2 4/2004 Okamoto (Continued)

FOREIGN PATENT DOCUMENTS

JP 61-49420 B2 10/1986

(Continued)

*Primary Examiner*—Danny Worrell
(74) *Attorney, Agent, or Firm*—Rothwell, Figg, Ernst & Manbeck, P.C.

(57) ABSTRACT

In a tubular knitted fabric with a stripe pattern knitted by a flat knitting machine, to cause cross-over yarns to appear inside the tubular knitted fabric so as to eliminate cutting operation of the cross-over yarns. For each knitting of a plurality of courses, a first knitted fabric portion and a second knitted fabric portion are continuously knitted by switching a first knitting yarn and a second knitting yarn. The first knitted fabric portion and the second knitted fabric portion are knitted by continuously performing a first knitting process for knitting the first knitted fabric and a second knitting process for knitting the second knitted fabric alternately. In each knitting process, knitting of one course is started from a part inside an end part of the knitting width of a front side knitted fabric (back side knitted fabric) by using a back side yarn feeding member (front side yarn feeding member), and while connecting the knitting start point and the knitting end point of the course so as to form a tubular shape, turn-back knitting is performed to the next course. At the turn-back position, the respective knitting yarns are made to cross inside the knitting width.

7 Claims, 5 Drawing Sheets

U.S. PATENT DOCUMENTS

| | | | | |
|---|---|---|---|---|
| 6,789,402 | B2 * | 9/2004 | Okamoto | 66/64 |
| 6,789,403 | B2 * | 9/2004 | Okamoto | 66/64 |
| 6,966,202 | B2 * | 11/2005 | Okuno | 66/64 |

FOREIGN PATENT DOCUMENTS

| | | | |
|---|---|---|---|
| JP | 3-75656 | B2 | 12/1991 |
| JP | 8-49144 | A | 2/1996 |
| JP | 10-1852 | A | 1/1998 |
| JP | 10/60758 | A | 3/1998 |
| JP | 2000-154447 | A | 6/2000 |
| JP | 2003-41461 | A | 2/2003 |
| WO | WO 01/16416 | A1 | 3/2001 |
| WO | WO 01/61092 | A1 | 8/2001 |

* cited by examiner

METHOD OF KNITTING TUBULAR KNITTED FABRIC HAVING STRIPE PATTERN, AND TUBULAR KNITTED FABRIC HAVING STRIPE PATTERN

CROSS REFERENCE TO RELATED APPLICATION

This application is a 35 USC §371 National Phase Entry Application from PCT/JP2004/011142, filed Aug. 4, 2004, and designating the United States.

TECHNICAL FIELD

The present invention relates to a method of knitting a tubular knitted fabric in which a stripe pattern is made in a tubular knitted fabric knitted using a flat knitting machine by switching knitting yarns to each other during knitting, and to a tubular knitted fabric having a stripe pattern.

BACKGROUND ART

When knitting a tubular knitted fabric in which a front side knitted fabric and a back side knitted fabric are continued by using a flat knitting machine, stitch courses of each knitted fabric are knitted roundly by feeding a knitting yarn alternately to the front side knitted fabric, to the back side knitted fabric, to the front side knitted fabric and so on, whereby a tubular knitted fabric is knitted in which the front side knitted fabric and the back side knitted fabric are connected to each other at the both ends of a knitting width of the knitted fabrics.

Further, when a stripe pattern is knitted, a back side knitted fabric is knitted one course by feeding a yarn to a needle of the back needle bed while moving a yarn feeding member in a direction either right or left, for example. Then, the yarn feeding member is moved in the opposite direction so as to feed the yarn to a needle of the front needle bed to thereby knit a front side knitted fabric of the same course. The course knitting is repeated for several times as appropriate so as to knit the stitch course of a first knitted fabric portion. Then, similar knitting is performed by switching the yarn to another knitting yarn of different color to thereby knit a second knitted fabric portion.

In this way, by switching the knitting yarns each time the prescribed number of courses is knitted roundly, a tubular knitted fabric with a stripe pattern having a first color and a second color alternately can be knitted.

In a flat knitting machine, the initial position of the yarn feeding member is right or left end side in a longitudinal direction of the needle bed, in general. Typically, switching of knitting yarns is performed at a needle at one end in a knitting width direction of the front side knitted fabric or the back side knitted fabric, as the starting point of the round knitting.

Further, at the switching part of knitting yarns which is the starting point of the round knitting, a cross-over yarn is caused, which appears outside the tubular knitted fabric. With such a cross-over yarn being appeared outside the tubular knitted fabric, the outer appearance is degraded. Therefore, cross-over yarns are cut after knitting and edge yarns are drawn inside the tubular knitted fabric, as shown in Patent Document 1.

In the tubular knitted fabric shown in Patent Document 1, binding processing is performed at the same time during knitting such that stitches will not be unraveled from the edge yarns drawn. Then, the cross-over yarns are cut, and the knitted fabric is extended, so that the edge yarns coming out to the right side of the knitted fabric are drawn inside the knitted fabric.

Further, there is a tubular knitted fabric having a stripe pattern in which a cross-over yarn is not cut, and the cross-over yarn is entangled in zigzag on a sinker loop which is two or three stitches inside in a wale direction from the end portion of the knitting width of the tubular knitted fabric, whereby a part of the cross-over yarn is not appeared outside the tubular knitted fabric (see Patent Document 2 for example).

Patent Document 1: Japanese Unexamined Patent Publication No. 8-49144

Patent Document 2: Japanese Examined Patent Publication No. 61-49420

DISCLOSURE OF THE INVENTION

Problems To Be Solved By the Invention

However, in the tubular knitted fabric having a stripe pattern shown in Patent Document 1, when a stripe pattern of a narrow width is knitted, the number of courses of one color is small, so the cross-over yarn is short. Further, when stripes are formed of plural rows, the number of cross-over yarns becomes large. Cutting operation of plural short cross-over yarns is very troublesome, and since the length of the cut edge yarn is short, the stitches are easily unraveled. Further, when a cross-over yarn is long, it is required to cut it to be an appropriate length such that the cut edge yarn is easily drawn inside the tubular knitted fabric.

Further, in a tubular knitted fabric having a stripe pattern shown in Patent Document 2, across-over yarn is entangled from the rear of the knitted fabric to a sinker loop which is two or three stitches inside in a wale direction from the end portion of the knitting width of the tubular knitted fabric. However, at a knitting yarn switching point, a cross-over of the yarn appears outside the tubular knitted fabric.

An object of the present invention is to provide a method of knitting a tubular knitted fabric having a stripe pattern and the tubular knitted fabric in which cross-over yarns caused due to switching of knitting yarns appear inside the tubular knitted fabric whereby cutting operation of the cross-over yarns is not necessary.

Means For Solving the Problems

In the present invention, the object described above is realized by a method of knitting a tubular knitted fabric having a stripe pattern, in which the tubular knitted fabric is knitted such that a front side knitted fabric and a back side knitted fabric are connected at side end parts of the knitting width in needle beds by using a flat knitting machine having at least a front and back pair of needle beds, and the tubular knitted fabric includes a part where a first knitted fabric portion and a second knitted fabric portion are continuously knitted by using a front side yarn feeding member and a back side yarn feeding member, and switching first and second different yarns to each other for each knitting of a plurality of courses. The method comprises a first knitting step for knitting the first knitted fabric portion and a second knitting step for knitting the second knitted fabric portion to thereby continuously and alternately knit the first knitted fabric portion and the second knitted fabric portion.

First, the first knitting process includes a process of starting knitting of one course from a part inside an end part of the knitting width of a front side knitted fabric by using the back side yarn feeding member while a knitting yarn forming a cross-over yarn being arranged on the inner face side of the tube of the tubular knitted fabric, and connecting a knitting start point and a knitting end point of the course so as to make it tubular while performing turn-back knitting for the next course, and crossing a first knitting yarn and a second knitting yarn to each other inside the knitting width at the turn-back position.

The second knitting process includes a process of starting knitting of one course from a part inside an end part of the knitting width of a back side knitted fabric by using the front side yarn feeding member while a knitting yarn forming a cross-over yarn being arranged on the inner face side of the tube of the tubular knitted fabric, and connecting a knitting start point and a knitting end point of the course so as to make it tubular while performing turn-back knitting for the next course, and crossing the first knitting yarn and the second knitting yarn to each other inside the knitting width at the turn-back position.

The present invention is characterized in that, in knitting a tubular knitted fabric, the knitted fabric is knitted in a tubular shape by not rounding in the same direction but performing turn-back knitting (so-called C-shape knitting)

The C-shape knitting is knitted so as to knit from the course knitting start loop in each of the knitting processes to a position of one end part of the knitting width, to thereby knit from one end part up to the other end part of the knitting width while moving to the knitted fabric knitted by the opposite needle bed, and then the rest of the course is knitted while turning back to the knitted fabric from which the knitting has started. Next, the knitting start loop and the knitting end loop are connected while turning back so as to knit the next course similarly. The turn-back position of the first knitted fabric portion is set within the front side knitted fabric, and the turn-back position of the second knitted fabric portion is set within the back side knitted fabric, whereby knitting is performed respectively.

Means for connecting the knitting start point and the knitting end point of a course by C-shape knitting include knitting and tucking. For example, when knitting the next course by turning back after forming a knitting end loop of a certain course, tucking is made to a needle on which the knitting start loop before turning back is held, whereby a knitting start loop continued from the knitting end loop of the previous course in a wale direction is formed. Further, knitting or tucking as a connecting means may be performed at both or one of the knitting start point and the knitting end point of the course. In the appearance, turn-back knitting by tucking is preferable.

It is preferable that a turn-back position of a course be proximity to an end part of the knitting width, and the turn-back knitting is knitted to an end part of the knitting width near thereto, first. By performing turn-back knitting in this way, a beautiful tubular knitted fabric can be knitted.

Here, when tucking is performed at a turn-back position of the course, it is preferable that tucking positions be an end part of the knitting width and a position of the second stitch from the end part of the knitting width alternately, and a knitting start loop be formed from the adjacent wale after tucked.

Further, in order to cross a first knitting yarn and a second knitting yarn to each other inside the knitting width at a turn-back position, when a loop is formed at the turn-back position, the front side yarn feeding member and the back side yarn feeding member are made to cross to each other inside the knitting width such that a knitting yarn forming a cross-over yarn is arranged on the inner face side of the tube of the tubular knitted fabric.

As a method for turn-back knitting and crossing of the first knitting yarn and the second knitting yarn, it is preferable to perform the first knitting process and the second knitting process through the following steps.

That is, the first knitting process includes: a first step of positioning the front side yarn feeding member inside the knitting width; a second step of starting knitting of a front side knitted fabric from a part inside an end part of the knitting width by using the back side yarn feeding member, and then knitting it in a direction separating from the stopped position of the front side yarn feeding member up to one end part of the knitting width of the front side knitted fabric; a third step of positioning the front side yarn feeding member outside the knitting width of the side where the back side yarn feeding member is positioned; a fourth step of continuously knitting a back side knitted fabric and the remaining front side knitted fabric of the course same as that of the second step by using the back side yarn feeding member; a fifth step of turning back from a turn-back position of the course knitted in the second step and the fourth step, and knitting a front side knitted fabric of the next course up to one end part of the knitting width, and then continuously knitting a back side knitted fabric; a sixth step of positioning the front side yarn feeding member inside the knitting width; and a seventh step of knitting the remaining front side knitted fabric of the course same as that of the fifth step by using the back side yarn feeding member.

Further, the second knitting process includes: a first step of positioning the back side yarn feeding member inside the knitting width; a second step of starting knitting of a back side knitted fabric from a part inside an end part of the knitting width by using the front side yarn feeding member, and then knitting it in a direction separating from the stopped position of the back side yarn feeding member up to one end part of the knitting width of the back side knitted fabric; a third step of positioning the back side yarn feeding member outside the knitting width of the side where the front side yarn feeding member is positioned; a fourth step of continuously knitting a front side knitted fabric and the remaining back side knitted fabric of the course same as that of the second step of this knitting process by using the front side yarn feeding member; a fifth step of turning back from a turn-back position of the course knitted in the second step and fourth step of this knitting process, and knitting a back side knitted fabric of the next course to one end part of the knitting width, and then continuously knitting a front side knitted fabric; a sixth step of positioning the back side yarn feeding member inside the knitting width; and a seventh step of knitting the remaining back side knitted fabric of the course same as that of the fifth step of this knitting process by using the front side yarn feeding member.

That is, in the present invention, a resting yarn feeding member is moved inside and outside of the knitting width in the way of one knitting process so as to cross the both knitting yarns inside the knitting width. Specifically, during knitting from the knitting start point to an end part of the knitting width of the first course, a resting yarn feeding member is kept inside the knitting width. Then, after the knitting to one end part of the knitting width ends, the resting yarn feeding member is moved outside the knitting width of the side of one end part of the knitting width. Then, the resting yarn feeding member is kept outside the knitting width until the knitting of the next course by turn-back knitting is moved to a needle bed for forming a knitting end loop. Next, after the resting yarn feeding member is moved inside the knitting width, knitting is performed up to the knitting end loop. In this way, by moving the resting yarn feeding member inside and outside the knitting width, a cross-over yarn is formed inside the knitting width and on the inner face side of the tube of the tubular knitted fabric while being crossed.

Each of the first knitting process and the second knitting process including the steps described above takes a knitting process in which two courses consists one unit. Therefore, by repeating the first knitting process and the second knitting process alternately by once each time, the first knitted fabric portion and the second knitted fabric portion are knitted by each two courses.

Further, at least one of the first knitting process and the second knitting process may be continued for plural number of times. By continuing it for plural number of times in this way, it is possible to change the width of the stripes appropriately.

The present invention is characterized in that in a tubular knitted fabric having a stripe pattern including a part in which a first knitted fabric portion and a second knitted fabric portion are continuously knitted by switching knitting yarns to each other for each knitting of plural courses, the first knitted fabric portion and the second knitted fabric portion are provided with turn-back positions inside an end part of the knitting width, and the turn-back position of the first knitted fabric portion is set within a front side knitted fabric and the turn-back position of the second knitted fabric portion is set within a back side knitted fabric so as to realize turn-back knitting. With such turn-back knitting, the present invention can provide a tubular knitted fabric having a stripe pattern in which both knitting yarns cross to each other inside the knitting width at a part of crossover yarns of the knitted fabric, and a cross-over yarn of each knitting yarn is provided on the inner face side of the tubular knitted fabric completely.

EFFECTS OF THE INVENTION

In the present invention, by repeating the first knitting process and the second knitting process alternately, it is possible to cross the both knitting yarns inside the knitting width while continuously knitting the first knitted fabric portion and the second knitted fabric portion for each knitting of plural courses.

As a result, in the present invention, when a stripe pattern is made by switching the knitting yarns to each other during knitting in the tubular knitted fabric by using a flat knitting machine, it is possible to eliminate cross-over yarns caused by switching of the knitting yarns coming out to the outside of the tubular knitted fabric.

Further, in the present invention, a resting yarn feeding member is moved inside and outside of the knitting width in the way of one of the knitting processes to thereby cross the knitting yarns fed from the both yarn feeding members inside the knitting width, and further the knitted fabric is knitted to be a tubular shape by performing C-shape knitting from the inside of the knitted width. Therefore, a cross-over of yarn is caused inside the tubular knitted fabric. Further, turn-back positions of the first knitted fabric portion and the second knitted fabric portion are provided within the front side knitted fabric and within the back side knitted fabric, respectively.

Therefore, cross-over yarns do not come out outside the tubular knitted fabric, so the outer appearance is beautiful and further, cutting operation of cross-over yarns is not required. Further, in the present invention, since turn-back positions of the first knitted fabric portion and the second knitted fabric portion are provided within the front side knitted fabric and within the back side knitted fabric to thereby form the tubular knitted fabric by C-shape knitting, a difference in level is not caused at a knitting yarn switching part.

Further, since at least one of the first knitting process and the second knitting process can be continued for plural times, it is possible to form strips of various widths without cutting cross-over yarns.

Further, in the C-shape knitting, the knitting start position of each course in each of the knitting processes is set near an end part of the knitting width, and the C-shape knitting is knitted from the knitting start position to an end part position of the knitting width near this start position, and then the C-shape knitting is knitted while moving to the opposite knitted fabric, a more beautiful tubular knitted fabric can be knitted.

In particular, when a turn-back part is connected by tucking, a tubular knitted fabric which is much more beautiful and perfect can be knitted by setting the tucking positions at an end part of the knitting width and the second stitch from the end part alternately.

Further, according to the tubular knitted fabric of the present invention, it is possible to provide a tubular knitted fabric having a stripe pattern in which cross-over yarns are formed inside the tubular knitted fabric so that the outer appearance makes beautiful.

Note that a tubular knitted fabric having a stripe pattern in the present invention can be applied not only to a stripe pattern of two colors but also to a stripe pattern using yarns of more than two colors. In such a case, for a stripe of the third color, cross-over yarns are cut as conventional cases and the edge yarns are drawn inside the knitted fabric. Even in a case of cutting cross-over yarns of the third color or after, cutting operation is easier comparing with a case of cutting all cross-over yarns as conventional cases.

BEST MODE FOR CARRYING OUT THE INVENTION

Next, preferred embodiments of the present invention will be explained in detail below.

First Embodiment

As a preferred embodiment of the present invention, explanation will be given for a first embodiment in which stripes of two colors are knitted alternately by each two courses.

FIG. 1 shows a loop structure near a knitting yarn switching part of a tubular knitted fabric 1. In FIG. 1, FB shows a front needle bed and BB shows a back needle bed. The line X-X is a boundary between a front side knitted fabric 11 and a back side knitted fabric 12, and in FIG. 1, a state of the right side being appeared is shown. Further, numbers with circles indicate the numbers of knitting steps shown in FIG. 2, and alphabetical letters indicate capital alphabetical letters showing loops in the knitting steps shown in FIG. 2.

FIG. 2 shows knitting steps of a striped tubular knitted fabric formed of plain stitches. Right and left arrows in this Figure show moving directions of a yarn feeding member, and K near the arrow indicates that knitting is also performed.

Further, in each step in FIG. 2, the lower row shows a front needle bed, the upper row shows a back needle bed, a to f indicate needle numbers of the front needle bed, and r to w indicate needle numbers of the back needle bed. In each step, a yarn shown by a continuous line is a first knitting yarn 7 used for knitting a first knitted fabric portion 2, and a yarn shown by a dotted line is a second knitting yarn 5 used for knitting a second knitted fabric portion 3. Further, in FIG. 2, a bold line shows a yarn knitted in the step, and narrow line shows a yarn which has been knitted in the previous steps.

Further, the front side knitted fabric 11 forming the tubular knitted fabric 1 is knitted by needles of the front needle bed, and the back side knitted fabric 12 forming the tubular knitted fabric 1 is knitted by needles of the back needle bed, respectively. The first knitted fabric portion 2 is knitted by two courses with the first knitting yarn 7 by using a back side yarn feeding member 6, and the second knitted fabric portion 3 is knitted by two courses with the second knitting yarn 5 by using a front side yarn feeding member 4.

The back side yarn feeding member 6 is positioned behind the front side yarn feeding member 4, and each yarn feeding member is movable along a yarn path rail in parallel with a longitudinal direction of the needle beds of the flat knitting machine.

Step S shows a state of each stitch which constitutes the tubular knitted fabric 1 being held on the needle bed, in which a loop of the left end part of the back side knitted fabric 12 in the second knitted fabric portion 3 is held on a needle "r" of the back needle bed as a knitting end loop in the second course of the second knitted fabric portion 3. Further, in step S, the front side yarn feeding member 4 and the back side yarn feeding member 6 are positioned inside the knitting width in the needle beds (same state as step 16). Note that the number of needles used for knitting is smaller than the actual number of needles for the sake of convenience in explanation.

Further, in the first knitted fabric portion 2, a position between a needle "a" on which a loop of the left end part of the front side knitted fabric 11 held on the front needle bed is held, and a needle "b" which is one stitch inside thereof, is a turn-back position (shown by the line Y-Y in FIG. 1). Further, in the second knitted fabric portion 3, a position between the needle "r" on which a loop of the left end part of the back side knitted fabric 12 held on the back needle bed is held, and a needle "s" which is one stitch inside thereof is a turn-back position (shown by the line Z-Z line in FIG. 1).

The first knitted fabric portion 2 of a stripe is knitted with the first knitting yarn 7 in steps 1 to 8 constituting a first knitting process described below. In step 1, the front side yarn feeding member 4 is kept inside the knitting width, and while the back side yarn feeding member 6 of the first knitting yarn 7 is moved to the left in FIG. 2, tucking A is performed by a needle "b" adjacent the needle "a" on which a loop of the left end part of the front side knitted fabric 11 in the front needle bed is held, and then a new loop B is formed to a needle "a" of the left end part. In this step 1, with the first knitting yarn 7 being fed from the back side yarn feeding member 6, the first knitting yarn 7 and the second knitting yarn 5 cross to each other inside the knitted fabric.

In step 2, in order that the front side yarn feeding member 4 will not interfere feeding of a yarn by the back side yarn feeding member 6, the front side yarn feeding member 4 is moved to the left so as to be positioned outside the knitting width. In step 3, the back side yarn feeding member 6 is moved to the right in FIG. 2, and a new loop C is formed to a needle "r" on which the loop of the left end part of the back side knitted fabric 12 of the back needle bed is held, and then the back side knitted fabric 12 is knitted for one course up to a needle "w" on which a loop of the right end part of the back side knitted fabric 12 is held.

In step 4, the back side yarn feeding member 6 is moved to the left in FIG. 2 so as to knit the front side knitted fabric 11 of the front needle bed from the right end part (needle "f") to a needle "b" which is one stitch inside the left end part. In step 5, while the back side yarn feeding member 6 is moved to the right and turned back, tucking D is performed to the needle "a" on which the loop of the left end part of the front side knitted fabric 11 is held, and then the front side knitted fabric 11 is knitted up to the right end part.

In step 6, while the back side yarn feeding member 6 is moved to the left in FIG. 2, the back side knitted fabric 12 of the back needle bed is knitted for one course from the right end part to the left end part. In step 7, in order to cross the first knitting yarn 7 and the second knitting yarn 5 to each other, the front side yarn feeding member 4 is moved to the right so as to be positioned from the outside to the inside of the knitting width.

In step 8, with the front side yarn feeding member 4 being kept inside the knitting width, a new loop E is formed to the needle "a", of the front needle bed, on which the loop of the left end part of the front side knitted fabric 11 is held, while the back side yarn feeding member 6 is moved to the right in FIG. 2. The first knitted yarn 7 after the loop E is formed serves as a first cross-over yarn 21 of the first knitted fabric portion 2.

Next, the second knitted fabric portion 3 of the stripe is knitted continuously with the second knitting yarn 5 in steps 9 to 16 constituting a second knitting process described below. In step 9, with the back side yarn feeding member 6 being kept inside the knitting width, tucking F is performed with a needle "s", of the back needle bed, next to the needle "r" on which the loop of the left end part of the back side knitted fabric 12 is held while the front side yarn feeding member 4 is moved to the left in FIG. 2, and then a new loop G is formed to the needle "r" of the left end part. In this step 9, with the second knitting yarn 5 being fed from the front side yarn feeding member 4, the first knitting yarn 7 and the second knitting yarn 5 cross to each other inside the knitted fabric.

In step 10, in order that the back side yarn feeding member 6 will not interfere with feeding of a yarn by the front side yarn feeding member 4, the back side yarn feeding member 6 is moved to the left so as to be positioned outside the knitting width. In step 11, while the front side yarn feeding member 4 is moved to the right in FIG. 2,a new loop H is formed to the needle "a", of the front needle bed, on which a loop of the left end part of the front side knitted fabric 11 is held, and then the front side knitted fabric 11 is knitted for one course up to the needle "f" of the right end part. In step 12, while the front side yarn feeding member 4 is moved to the left in FIG. 2, in the back needle bed, the back side knitted fabric 12 is knitted from the needle "w" of the right end part of the back side knitted fabric 12 up to a needle "s", at which a loop I is formed, which is one stitch inside the left end part of the back side knitted fabric 12.

In step 13, while the front side yarn feeding member 4 is moved to the right in FIG. 2 and turned back, tucking J is performed to a needle "r", in the back needle bed, on which a loop of the left end part of the back side knitted fabric 12 is held, and then a new loop K is formed with the next needle "s", and the front side knitted fabric 11 is knitted up to the right end part (needle "w"). In step 14, while the front side yarn feeding member 4 is moved to the left in FIG. 2, in the front needle bed, the front side knitted fabric 11 is knitted for one course from the right end part (needle "f") to the left end part (needle "a" where the loop L is formed) of the front side knitted fabric 11.

In step 15, in order to cross the first knitted yarn 7 and the second knitted yarn 5 to each other, the back side yarn feeding member 6 is moved to the right so as to be positioned from the outside to the inside of the knitting width. In step 16, with the back side yarn feeding member 6 being kept inside the knitting width, a new loop M is formed to the needle "r", in the back needle bed, on which the loop of the left end part of the back side knitted fabric 12 is held while the front side yarn feeding member 4 is moved to the right in FIG. 2. The second knitting yarn 5 after the loop M is formed serves as a second cross-over yarn 31 of the second knitted fabric portion 3.

By repeating steps 1 to 16 described above, a stripe pattern of two colors can be formed in which the first knitted fabric portion 2 and the second knitted fabric portion 3 are knitted continuously by each two courses. In the first embodiment, in order to cross the first knitting yarn 7 and the second knitting yarn 5 to each other, a resting yarn feeding member is moved inside the knitting width in the way of a process of knitting one of the knitted fabric portions to thereby cross the both knitting yarns inside the knitting width, as shown in step 7 and step 15. Further, since turned-back knitting by tucking, that is, so-called C-shape knitting is performed from the inside of the knitting width to thereby knit it to be tubular, across-over of yarns is caused inside the tubular knitted fabric.

As a result, a cross-over yarn caused by switching of knitting yarns does not come outside the tubular knitted fabric any more. Thereby, the outer appearance of the tubular knitted fabric is beautiful, and cutting operation of a cross-over yarn is not required anymore. Further, since the turn-back position of the first knitted fabric portion is provided within the front side knitted fabric and the turn-back position of the second knitted fabric portion is provided within the back side knitted fabric, and the tubular knitted fabric is formed by C-shape knitting, a difference in level is not caused at a knitting yarn switching position.

Second Embodiment

In the first embodiment described above, the first knitted fabric portion 2 and the second knitted fabric portion 3 are knitted by two courses each. However, as in a second embodiment, it is possible to knit four courses for each of the first knitted fabric portion 2 and the second knitted fabric portion 3 by increasing two courses each for the first knitted fabric portion 2 and the second knitted fabric portion 3 of the first embodiment.

That is, assuming that each of the first knitting process and the second knitting process in the first embodiment is one unit, the second embodiment can be realized by performing the same process twice. Hereinafter, the second embodiment will be explained specifically, based on the drawings. FIG. 3 shows the loop structure near a knitting yarn switching part of the tubular knitted fabric 1. Even in FIG. 3, the line X-X is a boundary between the front side knitted fabric 11 and the back side knitted fabric 12, and in FIG. 3, a state of the right side being appeared is shown. Further, numbers with circles indicate the numbers of knitting steps shown in FIGS. 4 and 5, and alphabetical letters indicate capital alphabetical letters showing loops in the knitting steps shown in the Figures.

FIGS. 4 and 5 show knitting steps of a tubular knitted fabric with stripes formed of plain stitches. FIG. 4 shows knitting steps of the first knitted fabric portion 2, following the steps 1 to 8 shown in FIG. 2. FIG. 5 shows knitting steps of the second knitted fabric portion 3, following the steps 9 to 16 shown in FIG. 2. Note that the second embodiment is knitted by using the same members as those of the first embodiment, and each Figure is shown on the conditions same as the first embodiment.

In the present embodiment, a process consisting of steps 1*a* to 8*a* shown in FIG. 4 is added between the step 8 and the step 9 of the first embodiment, and a process consisting of steps 9*a* to 16*a* shown in FIG. 5 is added after the step 16 of the first embodiment.

For the first knitted fabric portion 2 of the stripe, after the first knitting process, that is, steps 1 to 8 of the first embodiment, steps 1*a* to 8*a* are performed with the first knitting yarn 7. Since steps 1 to 8 are same as those of the first embodiment, explanation is omitted.

In step 1*a*, with the front side yarn feeding member 4 being kept inside the knitting width, while the back side yarn feeding member 6 of the first knitting yarn 7 is moved to the left in FIG. 4, tucking A is performed with a needle "b", in the front needle bed, next to the needle "a" on which a loop of the left end part of the front side knitted fabric 11 is held, and then a new loop B is formed to the needle "a" of the left end part. Here, since the front side yarn feeding member 4 is positioned inside the knitting width, a cross-over of the first knitting yarn 7 and the second knitting yarn 5 is not caused.

In step 2*a*, in order that the front side yarn feeding member 4 will not interfere with feeding of a yarn by the back side yarn feeding member 6, the front side yarn feeding member 4 is moved to the left so as to be positioned outside the knitting width. In step 3*a*, while the back side yarn feeding member 6 is moved to the right in FIG. 4,a new loop C is formed to the needle "r", in the back needle bed, on which a loop of the left end part of the back side knitted fabric 12 is held, and then the back side knitted fabric 12 is knitted for one course up to the needle "w" on which a loop of the right end part of the back side knitted fabric 12 is held.

In step 4*a*, while the back side yarn feeding member 6 is moved to the left in FIG. 4, the front side knitted fabric 11 in the front needle bed is knitted from the right end part (needle "f") to the needle "b", to which a loop is formed, which is one stitch inside the left end part. In step 5*a*, while the back side yarn feeding member 6 is moved to the right in FIG. 4 and turned back, tucking D is performed to the needle "a", in the front needle bed, on which a loop of the left end part of the front side knitted fabric 11 is held, and then the front side knitted fabric 11 is knitted up to the right end part (needle "f").

In step 6*a*, while the back side yarn feeding member 6 is moved to the left, the back side knitted fabric 12 in the back needle bed is knitted for one course from the right end part (needle "w") to the left end part (needle "r"). In step 7*a*, in order to cross the first knitted yarn 7 and the second knitted yarn 5 to each other, the front side yarn feeding member 4 is moved to the right so as to be positioned from the outside to the inside of the knitting width.

In step 8*a*, with the front side yarn feeding member 4 being positioned inside the knitting width, while the back side yarn feeding member 6 is moved to the right in FIG. 4, a new loop E is formed to the needle "a", in the front needle bed, on which a loop of the left end part of the front side knitted fabric 11 is held. The first knitted yarn 7 after the loop E is formed serves as a first cross-over yarn 21 of the first knitted fabric portion 2.

Next, for the second knitted fabric portion 3 of the stripe, after the second knitting step, that is, steps 9 to 16 of the first embodiment, knitting is performed in steps 9*a* to 16*a* with the second knitting yarn 5. Steps 9 to 16 are same as those of the first embodiment so explanation is omitted.

In step 9*a*, with the back side yarn feeding member 6 being kept inside the knitting width, while the front side yarn feeding member 4 is moved to the left in FIG. 5, tucking F is performed with the needle "s", in the back needle bed, next to the needle "r" on which a loop of the left end part of the back side knitted fabric 12 is held, and then a new loop G is formed to the needle "r" of the left end part. Here, since the back side yarn feeding member 6 is positioned inside the knitting width, a cross-over of the first knitting yarn 7 and the second knitting yarn 5 is not caused.

In step 10*a*, in order that the back side yarn feeding member 6 will not interfere with feeding of a yarn by the front side yarn feeding member 4, the back side yarn feeding member 6 is moved to the left so as to be positioned outside the knitting width. In step 11*a*, while the front side yarn feeding member 4 is moved to the right in FIG. 5, a new loop H is formed to the needle "a", in the front needle bed, on which a loop of the left end part of the front side knitted fabric 11 is held, and then the front side knitted fabric 11 is knitted for one course up to the right end part (needle "f"). In step 12*a*, while the front side yarn feeding member 4 is moved to the left in FIG. 5, the back side knitted fabric 12 in the back needle bed is knitted from the right end part (needle "w") of the back side knitted fabric 12 to the needle "s", which is one stitch inside the left end part, to which a loop I is formed.

In step 13*a*, while the front side yarn feeding member 4 is moved to the right in FIG. 5 and turned back, tucking J is performed to the needle "r", in the back needle bed, on which a loop of the left end part of the back side knitted fabric 12 is held, and then a new loop K is formed with the adjacent needle "s", whereby the back side knitted fabric 12 is knitted up to the right end part (needle "w"). In step 14*a*, while the front side yarn feeding member 4 is moved to the left in FIG. 5, the front side knitted fabric 11 in the front needle bed is knitted for one course from the right end part (needle "f") to the needle "a" to which a loop L of the left end part of the front side knitted fabric 11 is formed.

In step 15*a*, in order to cross the first knitting yarn 7 and the second knitting yarn 5 to each other, the back side yarn feeding member 6 is moved to the right so as to be positioned from the outside to the inside of the knitting width. In step 16*a*, with the back side yarn feeding member 6 being kept inside the knitting width, while the front side yarn feeding member 4 is moved to the right in FIG. 5, a new loop M is formed to the needle "r", in the back needle bed, on which a loop of the left end part of the back side knitted fabric 12 is held. The second knitting yarn 5 after the loop M is formed serves as a second cross-over yarn 31 of the second knitted fabric portion 3. By repeating steps 1 to 8, 1*a* to 8*a*, 9 to 16 and 9*a* to 16*a*, the first knitted fabric portion 2 and the second knitted fabric portion 3 are knitted continuously by each four courses, whereby a strip pattern of two colors is formed. Note that by combining the continuation numbers of each of the first knitting process and the second knitting process, it is possible to form stripes of various widths without cutting cross-over yarns, which is not limited to the second embodiment.

Further, when knitting a stripe pattern of large width (having large number of courses), it is possible to prevent a cross-over yarn from being elongated in a free state by connecting the cross-over yarn extending between knitting yarn switching parts to the knitted fabric by tacking or the like. For example, when moving a resting yarn feeding member in any one of steps 2*a* and 7*a* in FIG. 4 and steps 10*a* and 15*a* in FIG. 5, the cross-over yarn is connected to the knitted fabric by tucking or the like.

In the present invention, it is preferable that a knitting yarn switching part be at any of second to fifth stitches near the side end of the knitting width. In particular, as shown in the first embodiment and the second embodiment, the second stitch from the side end part of the knitting width is most preferable. In the case where a knitting yarn switching part is set near the side end of the knitting width, it is suitable for knitted clothes.

Besides knitted clothes, it is possible to perform the knitting method of the present invention near the center of the knitting width, not limited to proximity to the knitting width.

INDUSTRIAL APPLICABILITY

The present invention is optimum for knitting a tubular knitted fabric with a stripe pattern in which cross-over yarns are provided inside the tube.

DESCRIPTION OF REFERENCE NUMERALS

Figure 1:
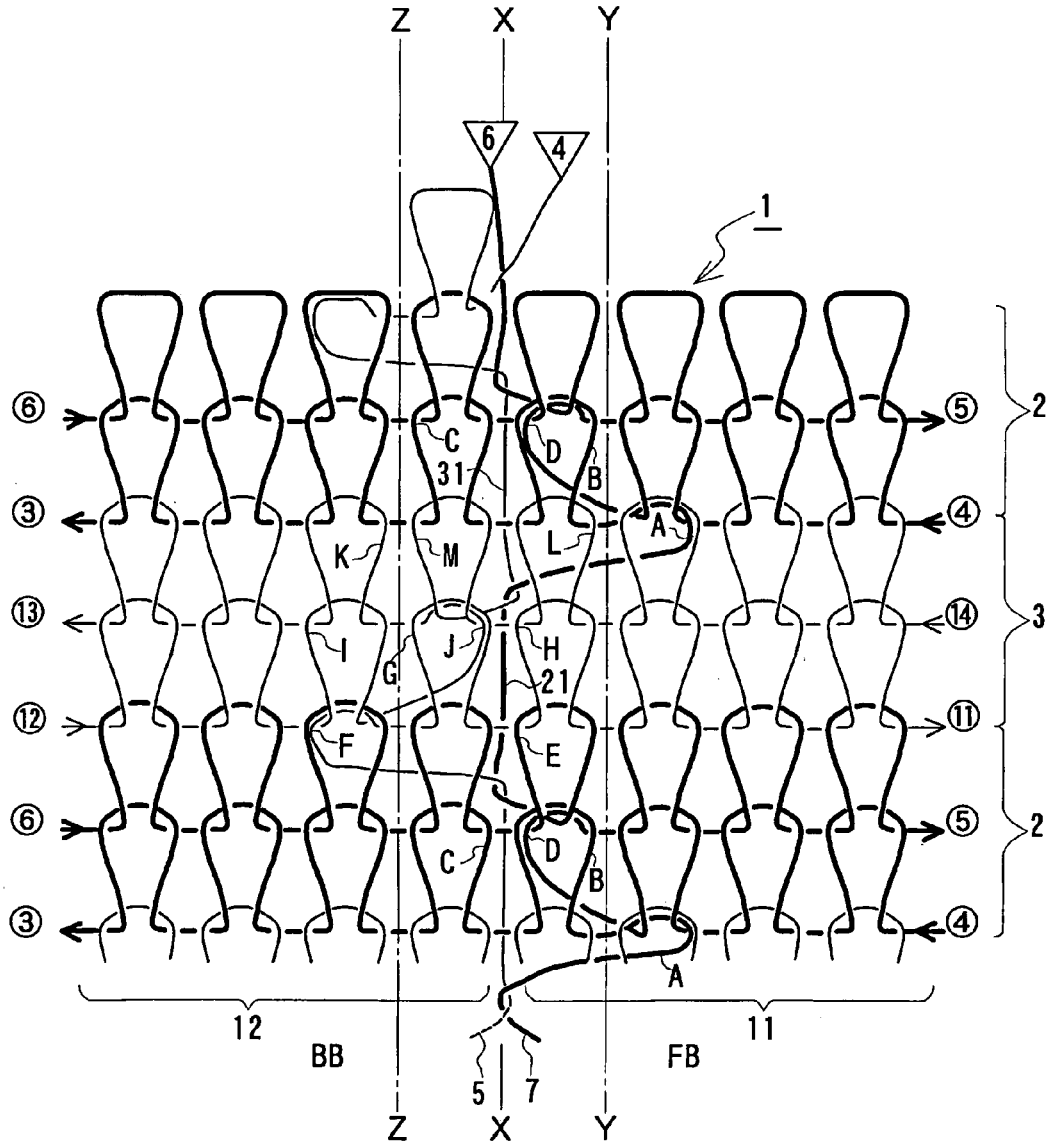
FIG. 1 shows a loop diagram near a knitting yarn switching part of a tubular knitted fabric according to a first embodiment.
Figure 2:
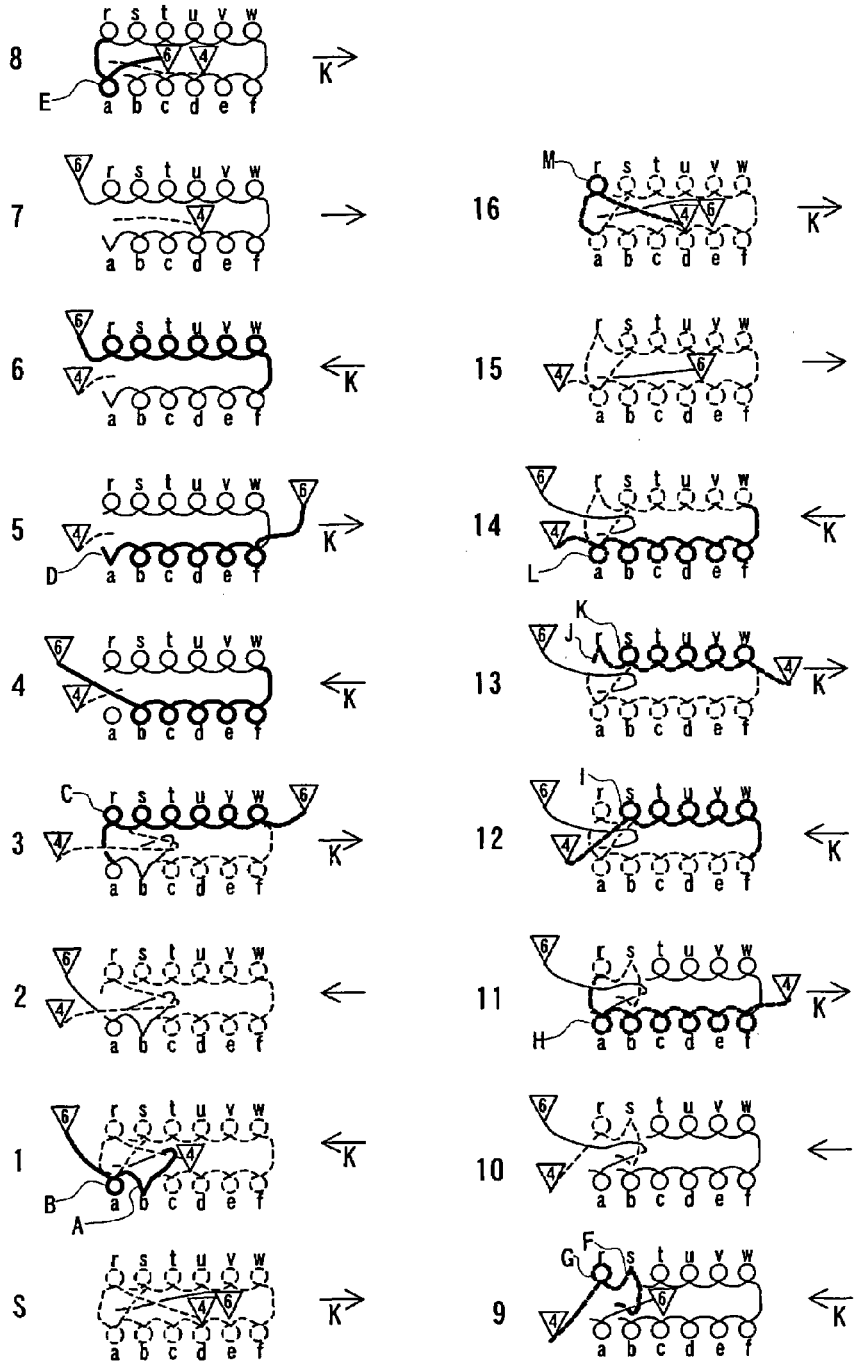
FIG. 2 is an illustration showing knitting steps of a tubular knitted fabric with a stripe pattern according to the first embodiment.
Figure 3:
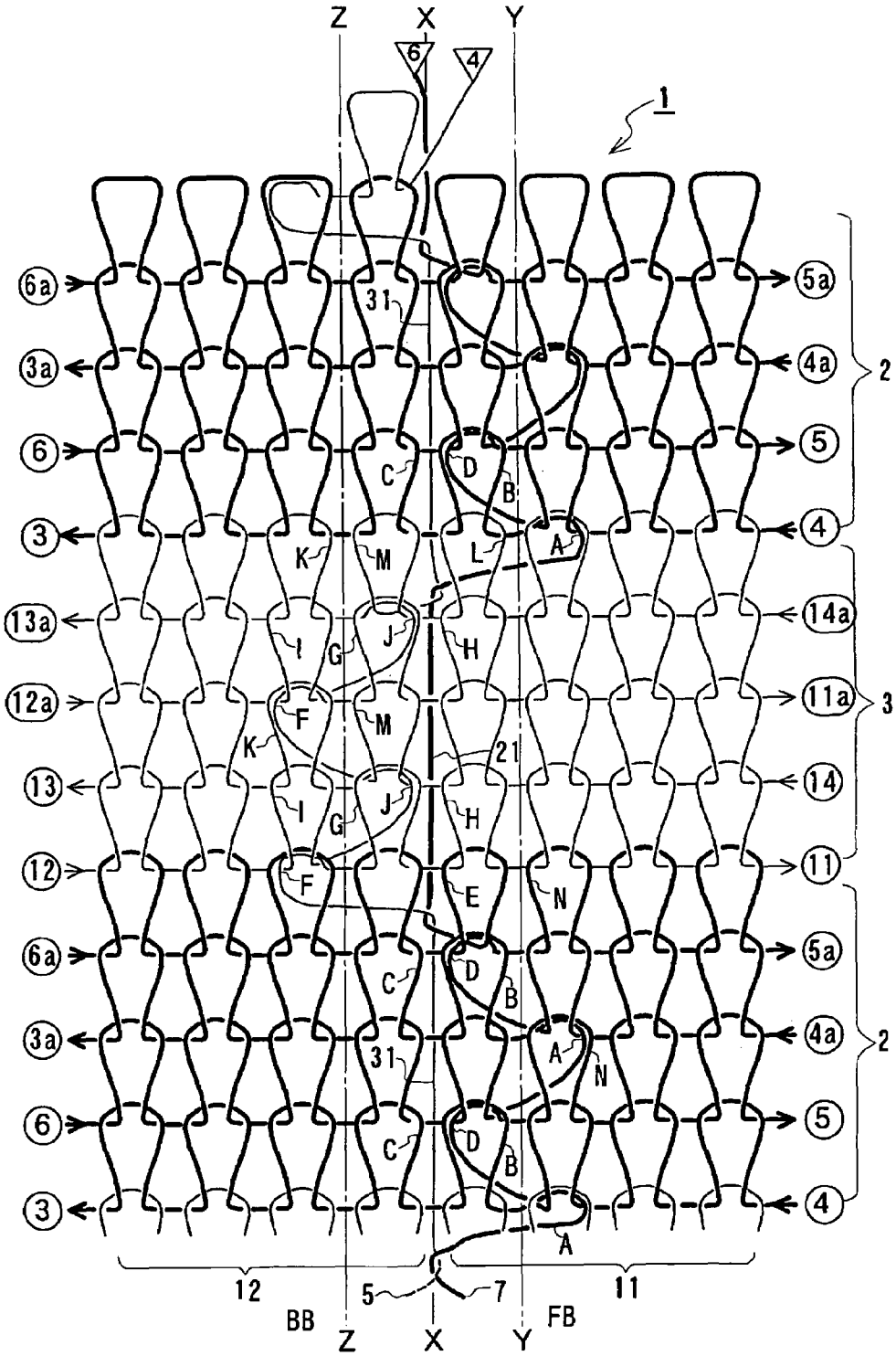
FIG. 3 shows a loop diagram near a knitting yarn switching part of a tubular knitted fabric according to a second embodiment.
Figure 4:
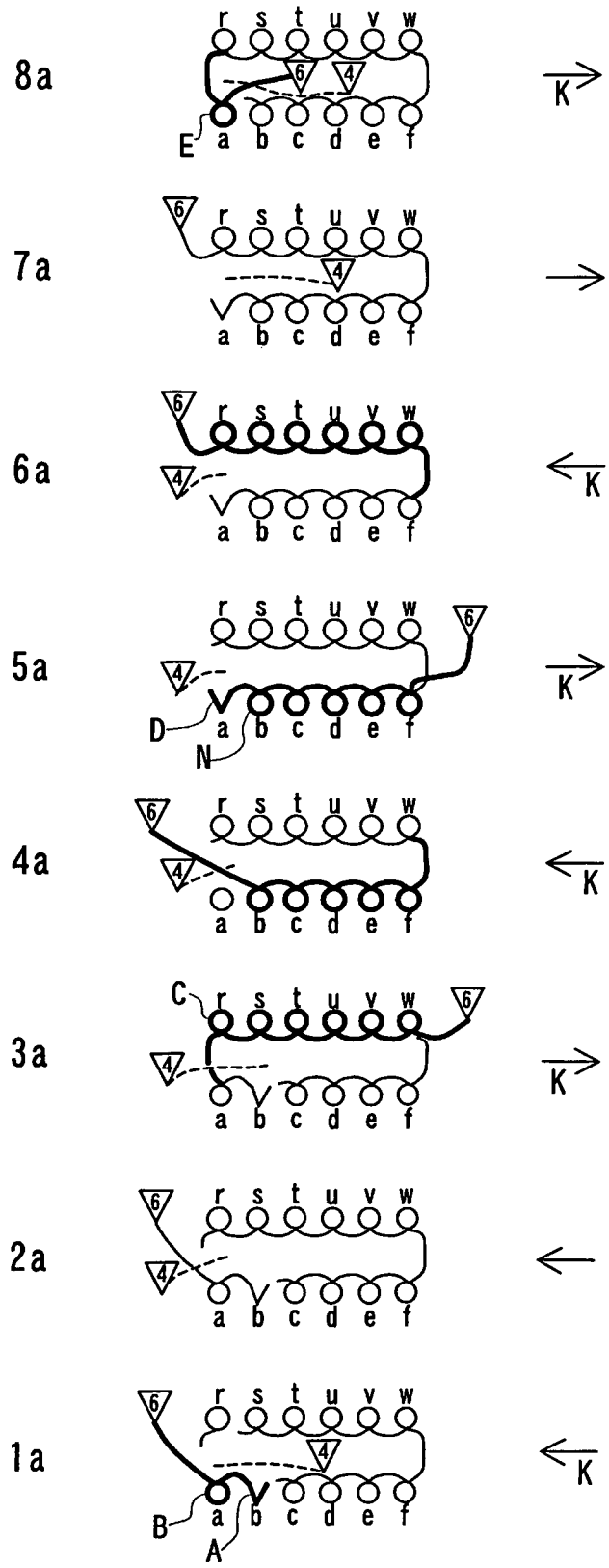
FIG. 4 is an illustration showing knitting steps 1*a* to 8*a* of a tubular knitted fabric with a stripe pattern according to the second embodiment.
Figure 5:
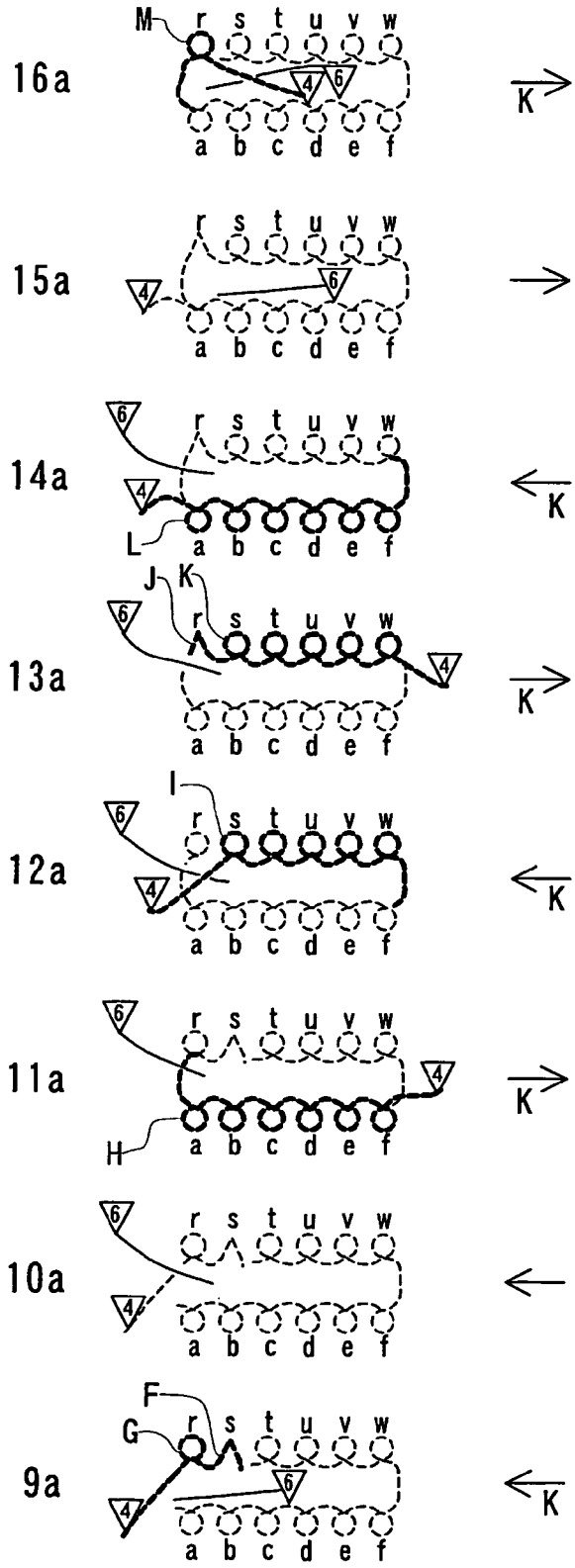
FIG. 5 is an illustration showing knitting steps 9*a* to 16*a* of a tubular knitted fabric with a stripe pattern according to the second embodiment.

1 tubular knitted fabric
11 front side knitted fabric
12 back side knitted fabric
2 first knitted fabric portion
3 second knitted fabric portion
4 front side yarn feeding member
6 back side yarn feeding member
21 first cross-over yarn
31 second cross-over yarn
5 second knitting yarn
7 first knitting yarn

The invention claimed is:

1. A method of knitting a tubular knitted fabric having a stripe pattern, in which the tubular knitted fabric is knitted such that a front side knitted fabric and a back side knitted fabric are connected at side end parts of a knitting width in needle beds by using a flat knitting machine having at least a front and back pair of needle beds, and the tubular knitted fabric includes a part where a first knitted fabric portion and a second knitted fabric portion are continuously knitted by using a front side yarn feeding member and a back side yarn feeding member and switching first and second different yarns to each other for each knitting of a plurality of courses, the method comprising a first knitting step for knitting the first knitted fabric portion and a second knitting step for knitting the second knitted fabric portion to thereby continuously and alternately knit the first knitted fabric portion and the second knitted fabric portion, wherein the first knitting process includes a process of:

starting knitting of one course from a part inside an end part of the knitting width of a front side knitted fabric by using the back side yarn feeding member while a knitting yarn forming a cross-over yarn being arranged on an inner face side of a tube of the tubular knitted fabric, and connecting a knitting start point and a knitting end point of the course so as to make it tubular while performing turn-back knitting for a next course, and crossing a first knitting yarn and a second knitting yarn to each other inside the knitting width at a turn-back position; and the second knitting process includes a process of:

starting knitting of one course from a part inside an end part of the knitting width of a back side knitted fabric by using the front side yarn feeding member while a knitting yarn forming a cross-over yarn being arranged on an inner face side of a tube of the tubular knitted fabric, and connecting a knitting start point and a knitting end point of the course so as to make it tubular while performing turn-back knitting for a next course, and crossing the first knitting yarn and the second knitting yarn to each other inside the knitting width at a turn-back position.

2. The method of knitting the tubular knitted fabric with the stripe pattern as claimed in claim 1, wherein the first knitting process comprises:

a first step of positioning the front side yarn feeding member inside the knitting width;

a second step of starting knitting of the front side knitted fabric from a part inside an end part of the knitting width by using the back side yarn feeding member, and then knitting it in a direction separating from a stopped position of the front side yarn feeding member up to one end part of the knitting width of the front side knitted fabric;

a third step of positioning the front side yarn feeding member outside the knitting width of a side where the back side yarn feeding member is positioned;

a fourth step of continuously knitting a back side knitted fabric and a remaining front side knitted fabric of the course same as that of the second step by using the back side yarn feeding member;

a fifth step of turning back from a turn-back position of the course knitted in the second step and the fourth step, and knitting a front side knitted fabric of a next course up to one end part of the knitting width, and then continuously knitting a back side knitted fabric;

a sixth step of positioning the front side yarn feeding member inside the knitting width; and a seventh step of knitting a remaining front side knitted fabric of the course same as that of the fifth step of the back side yarn feeding member, and the second knitting process comprises:

a first step of positioning the back side yarn feeding member inside the knitting width;

a second step of starting knitting of a back side knitted fabric from a part inside an end part of the knitting width by using the front side yarn feeding member, and then knitting it in a direction separating from a stopped position of the back side yarn feeding member up to one end part of the knitting width of the back side knitted fabric;

a third step of positioning the back side yarn feeding member outside the knitting width of a side where the front side yarn feeding member is positioned;

a fourth step of continuously knitting a front side knitted fabric and a remaining back side knitted fabric of the course same as that of the second step of this knitting process by using the front side yarn feeding member;

a fifth step of turning back from a turn-back position of the course knitted in the second step and fourth step of this knitting process, and knitting a back side knitted fabric of a next course up to one end part of the knitting width, and then continuously knitting a front side knitted fabric;

a sixth step of positioning the back side yarn feeding member inside the knitting width; and a seventh step of knitting a remaining back side knitted fabric of the course same as that of the fifth step of this knitting process by using the front side yarn feeding member.

3. The method of knitting the tubular knitted fabric with the stripe pattern as claimed in claim 1, wherein at least one of the first knitting process and the second knitting process is continued for plural number of times.

4. The method of knitting the tubular knitted fabric with the stripe pattern as claimed in claim 1, wherein a course knitting start position is set near an end part of the knitting width, and after knitting is performed up to an end part position of the knitting width of a side near the knitting start position, knitting is performed while moving to an opposite needle bed.

5. The method of knitting the tubular knitted fabric with the stripe pattern as claimed in claim 2, wherein a course knitting start position is set near an end part of the knitting width, and after knitting is performed up to an end part position of the knitting width of a side near the knitting start position, knitting is performed while moving to an opposite needle bed.

6. The method of knitting the tubular knitted fabric with the stripe pattern as claimed in claim 3, wherein a course knitting start position is set near an end part of the knitting width, and after knitting is performed up to an end part position of the knitting width of a side near the knitting start position, knitting is performed while moving to an opposite needle bed.

7. A tubular knitted fabric with a stripe pattern including a part in which a first knitted fabric portion and a second knitted fabric portion are continuously knitted by switching knitting yarns to each other for each knitting of plural courses, wherein the first knitted fabric portion and the second knitted fabric portion are knitted to be in a tubular shape by turn-back knitting and have turn-back positions inside an end part of the knitting width, and the turn-back position of the first knitted fabric portion is set within a front side knitted fabric and the turn-back position of the second knitted fabric portion is set within a back side knitted fabric so as to realize turn-back knitting, whereby both knitting yarns cross to each at a part of cross-over yarn of the knitted fabric, and a cross-over yarn of each knitting yarn is provided on an inner face side of the tubular knitted fabric.

* * * * *